United States Patent [19]

Rushmere

[11] 4,046,648

[45] Sept. 6, 1977

[54] POLYAMINE ADDITIVES IN ALKALINE ZINC ELECTROPLATING

[75] Inventor: John Derek Rushmere, Wilmington, Del.

[73] Assignee: E. I. Du Pont de Nemours and Company, Wilmington, Del.

[21] Appl. No.: 617,539

[22] Filed: Sept. 29, 1975

[51] Int. Cl.[2] ..... C25D 3/22; C25D 3/24

[52] U.S. Cl. ..... 204/55 R; 204/DIG. 2; 204/55 Y; 260/2 BP

[58] Field of Search ..... 204/55 R, 55 Y, DIG. 2; 260/2 A, 2 BP

[56] References Cited

U.S. PATENT DOCUMENTS

| | | | |
|---|---|---|---|
| 2,485,563 | 10/1949 | Chester et al. | 204/55 Y |
| 2,791,554 | 5/1957 | Winters | 204/55 Y |
| 3,031,504 | 4/1962 | Pollitzer | 260/2 BP |
| 3,219,560 | 11/1965 | Leenders et al. | 204/52 Y |
| 3,317,412 | 5/1967 | Dahlmann | 204/55 R |
| 3,853,718 | 10/1974 | Creutz | 204/55 R |
| 3,856,637 | 12/1974 | Kessler | 204/29 |
| 3,988,219 | 10/1976 | Rosenberg | 204/55 R |
| 4,007,098 | 2/1977 | Rosenberg | 204/55 R |

*Primary Examiner*—F.C. Edmundson

[57] ABSTRACT

Alkaline zinc electroplating, from baths with small amounts of cyanide or cyanide-free, is enhanced by the use of certain water-soluble polyamines as brighteners. These are the reaction products of first condensing an alkanolamine with an epihalohydrin, and then reacting the condensation product with an amine.

25 Claims, No Drawings

POLYAMINE ADDITIVES IN ALKALINE ZINC ELECTROPLATING

BACKGROUND OF THE INVENTION

This invention relates to additives for the electroplating of zinc. More particularly, it relates to polyamine brighteners for such electroplating.

The use of a variety of polyamines in various types of alkaline zinc plating is now common commercial practice, as reflected in the U.S. patents discussed below. Polyamines formed by the reaction of epichlorohydrin with ammonia or ethylenediamine are disclosed in Winters, U.S. Pat. No. 2,791,554 (1957). More recently, Rosenberg, U.S. Pat. No. 3,803,008 (1974), discloses polyamines from the reaction of epichlorohydrin with secondary and tertiary cyclic amines. Still more recently, Nobel et al., U.S. Pat. 3,869,358 (1975), and Duchene et al., U.S. Patents 3,871,974 and 3,886,054 (1975), disclose the use of quaternary polyamines formed by reacting epichlorohydrin with dimethylaminopropylamine and more preferably such polyamines further quaternized with alkyl halides and sulfates. The Duchene et al. polyamines include the uncrosslinked polyamines disclosed in an earlier patent to Greer, U.S. Patent 3,642,663 (1972), not connected with electroplating, and also use mercapto compounds. Similarly procedures detailed by Nobel et al. for the preparation of polyamines are essentially those of Greer. Nobel et al. also list triethanolamine as an example of an amine capable of forming a useful polyamine by condensation with epichlorohydrin.

However useful these compositions may be, it is desirable to have still better additives for zinc electroplating.

SUMMARY OF THE INVENTION

The present invention provides an aqueous addition agent for the electrodeposition of zinc from an alkaline bath, said addition agent comprising a water-soluble polyamine brightener prepared by condensing an alkanolamine with an epihalohydrin in proportions of at least about 2 moles of epihalohydrin per mole of alkanolamine to produce a condensation product which is essentially completely watersoluble and free from epihalohydrin, and reacting said condensation product with at least 0.3 mole of an amine per mole of alkanolamine until the total ionic halogen is at least about 1 mole per mole of alkanolamine to produce said polyamine.

These addition agents are used in alkaline aqueous zinc electroplating baths, with a small amount of cyanide or cyanide-free, along with zinc ions and optionally other conventional additives.

Otherwise conventional electroplating processes using these baths are also part of the invention.

Percentages and proportions herein are by weight, and moles are gram molecular weights except where indicated otherwise.

DETAILED DESCRIPTION OF THE INVENTION

It has been found that polyamine additives of the invention exhibit superior performance in zinc electroplating compared to alkanolamine-epihalohydrin condensation products like those of the prior art if the condensation product is further reacted with further amounts of amines, especially when the amines are chosen so as to lead to some cross-linking in the polymer.

Epoxides such as epichlorohydrin condense with both amines and alcohols in reactions typified by

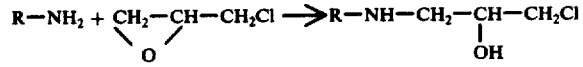

and

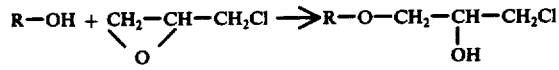

R = alkyl or aryl group.

Alcohols are generally less reactive than amines and usually require the presence of a catalyst which may be either acidic or basic. Alkanolamines (which are bases) act as self catalysts and provide in one molecule both amine and alcohol functions capable of undergoing reaction with epichlorohydrin. Thus, in the reaction of diethanolamine with two moles of epichlorohydrin a primary condensation such as:

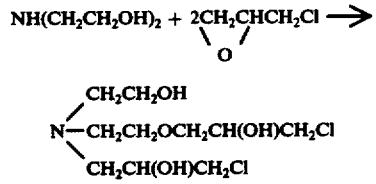

takes place.

Under suitable reaction conditions (heat) two or more moles of this primary condensation product can undergo self quaternization to yield an initial quaternary polyamine such as:

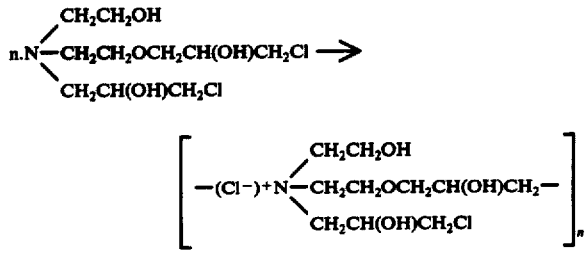

where $n \geqq 2$.

While the structures of the reaction products are not exactly known, they may include both ring structures and linear polymers. Thus, the above structures are meant to be illustrative rather than definitive. The nonionic chlorine in the quaternary polyamine so formed is available for further reaction with up to an additional mole of an amine.

Generally, if the final product is required for alkaline cyanide-free zinc electroplating, it is preferred to add secondary or tertiary amines such as diethylamine and triethylamine either alone or in mixtures. Most preferably, one uses a bisamine containing a tertiary amine function, as for example, dimethylaminoproplyamine, so that some cross-linking between polyamine chains can occur.

However, if the final product is required for alkaline cyanide zinc plating, it is preferred to react the initial alkanolamine/epihalohydrin condensation products with ammonia or primary amines and especially primary bisamines such as ethylene diamine so that the final polyamines contain a greater preponderance of primary and secondary amine groups. Such primary and secondary amine groups appear to be preferred in polyamines used for electroplating from alkaline cyanide zinc baths in contrast to the preference for a preponderance of tertiary and quaternary amine groups in polyamines used for electroplating from cyanide-free alkaline zinc baths.

Among the alkanolamines which have been found to yield useful products for the invention by this reaction sequence are monoethanolamine, diethanolamine, triethanolamine, N-methyl diethanolamine, N,N,N',N'-tetrakis-(hydroxyethyl)-ethylenediamine, tris-(hydroxymethyl) aminomethane, di-(hydroxypropyl)-amine, hydroxyethylpyridine, N-hydroxyethylpyrolidine, hydroxyethyl aniline. Diethanolamine is the preferred choice. Instead of the preferred epichlorohydrin, one could use epibromohydrin or epiiodohydrin.

Among the amines which have been found useful for the invention for the second stage of the reaction are ammonia, ethylamine, diethylamine, triethylamine, ethylenediamine, N,N-dimethylaminopropylamine, N,N,N',N'-tetramethylethylene diamine, imidazole, aminopyridine and the like. Dimethylaminopropylamine and ethylene diamine are preferred choices.

Various combinations and ratios of the reactants may be employed to give useful products although generally it is preferred to use at least about 2 moles of epihalohydrin per mole of alkanolamine for the initial stage of the polymer preparation and to use at least 0.3 mole of the amine for the second stage of the preparation. The optimum amount of amine appears to be in the range of about 0.5 to 1 mole, such as about 0.8 moles, although mole amounts up to one less than the moles of epihalohydrin added can also be used for the production of highly useful products.

In conducting the preparation of the polyamines of the invention, the alkanolamine is charged to a suitable vessel equipped with stirrer, reflux condenser and temperature recording device. Water or other water miscible solvent such as isopropanol or acetone may be present, but is not required. Epihalohydrin is then added either batchwise or continuously with or without heat or cooling to the reaction vessel in such a manner that the temperature is maintained between about 50 and 150° C. The exact conditions of the epihalohydrin addition vary depending on the alkanolamine used. Thus with diethanolamine, a vigorous exotherm occurs, and batchwise addition of epihalohydrin may be used to maintain the temperature of reaction. With triethanolamine, however, only a very slight exotherm occurs; consequently, all the epihalohydrin may be added initially and heat supplied to maintain the temperature of reaction.

After all the epihalohydrin has been added, stirring is continued and the reaction temperature maintained with applied heat if necessary. During this period the mixture becomes increasingly viscous and the ionic chloride content increases approaching a mole value equivalent to that of the alkanolamine initially charged. The increasing ionic chloride content and viscosity are both indicative of the initial polymerization. The extent of polymerization and cross-linking is not critical, but it is considered that the amounts occurring with the preferred processes are desirable. Thus, the molecular weight of the reaction product will be between that of the monomeric product and that found at the solubility limit. The reaction temperature is maintained for about 4 to 16 hours until the initial product is completely water-soluble, i.e., until there is no evidence of oily, water-insoluble epichlorohydrin on adding the product to water. At this stage the ionic chloride content of the product is usually at least about 0.5 or more mole per mole of alkanolamine used. After cooling, water is added to this initial product to give a solution containing about 50 weight percent solids followed by the desired quantity of amine or mixed amines, and the whole is refluxed for about two hours to give the desired polyamines of the invention.

In practicing the use of the polyamines in the electroplating of zinc, alkaline baths which are either cyanide-free or cyanide-containing can be employed. Typical bath compositions are as follows:

| | Cyanide-Free | | Cyanide Containing | |
|---|---|---|---|---|
| | Range | Preferred | Range | Preferred |
| Zinc Metal g/l | 6–12 | 8 | 6–15 | 10 |
| Sodium Hydroxide g/l | 75–110 | 90 | 75–110 | 75 |
| Sodium Cyanide g/l | — | — | 8–24 | 15 |

Alkaline baths based on potassium rather than sodium hydroxide and cyanide can also be used. Normal alkaline zinc electroplating conditions are desirable, including a pH above about 12 and temperatures in the range of about 20° to 65° C.

The polyamines of the invention are usually used in amounts of about 0.1 to 5 g/l although larger amounts may also be used. Used by themselves the polyamines produce smooth semi-bright plate of acceptable commercial quality. However, to produce the fully bright zinc now required by commerce, the presence of at least one other additive known to the art is also required. This other additive is present in amounts of about 0.1 to 5 g/l, preferably 0.1 to 2 g/l, and is selected from the groups of organic compounds comprising aromatic aldehydes such as anisaldehyde, veratraldehyde, piperonel, o-, m- and p-hydroxybenzaldehydes, vanillin and the like and 1-alkyl 3-substituted pyridinium compounds such as described in U.S. Pat. Nos. 3,318,787 — Rindt et al. (1967) and 3,411,996 — Rushmere (1968), hereby incorporated herein by reference. Of all of these compounds 1-benzyl pyridinium 3-carboxylate disclosed in U.S. Patent 3,411,996 is the most preferred. The weight ratio of 1-alkyl 3-substituted pyridinium compound. Optionally, to produce and aromatic aldehyde to polyamine preferably is between 1:100 electroplates showing the greatest bright plating range and and 100:1 brightness and luster of the deposit, it is desirable that a metal-sequestering agent be present. Practically any such agent can be used although it is preferred to use the less powerful agents since then the recovery of zinc from rinse waters is not unduly inhibited. Preferred sequestering agents are Rochelle salt (sodium potassium tartrate), sodium glucoheptonate, sorbitol and the like used in amounts of about 1 to 15 g/l.

The polyamines of the invention are conveniently added to plating baths as aqueous solutions. Such aqueous solution additives may contain from 2 to 50% of polyamine although generally a concentration range of 2 to 20% is preferred. Such aqueous addition agents may also contain other brightening agents such as the aromatic aldehydes or pyridinium compounds in amounts of 2 to 20%.

PREPARATION 1 - Preparation of an Initial Diethanolamine (1 mole)/Epichlorohydrin (2 moles) Condensation Product To a 22 l flask fitted with a stirrer, reflux condenser and heating mantle were charged 3000 g (28.6 moles) of diethanolamine and 515 g (28.6 moles) of water. To the stirred mixture, 5300 g (57.2 moles) of epichlorohydrin were added over the next 3.5 hours in increments of not less than 100 g. The strongly exothermic heat of reaction rapidly raised the temperature of the flask and its contents to 120° C and maintained it at about this temperature for the next 5.5 hours. Subsequently, during the next 16 hours the temperature fell to 40° C to give a clear, very viscous, dark amber colored melt. 4000 g of water were added to dissolve the melt and render it more manageable. A 225 g sample of this aqueous product was removed for comparative testing and analysis. It was found to be completely water-soluble with no evidence of oily water insoluble epichlorohydrin. The ionic chloride content was found to be 38.4% of that originally charged as epichlorohydrin. Gas chromatographic analysis showed the residual epichlorohydrin to be only 0.3%, i.e., 99.2% of the epichlorohydrin originally charged was reacted.

PREPARATION 2 — Formation of Diethanolamine (1 mole)/Epi-Chlorohydrin (2 moles)/Dimethylaminopropylamine (0.8 mole) Polyamine To the diethanolamine/epichlorohydrin condensation product of Preparation 1 were added a further 1000 g water and 2320 g (22.6 moles) of dimethylaminopropylamine. This gives molar ratios of ingredients of diethanolamine/epichlorohydrin/dimethylaminopropylamine of about 1:2:0.8. As a result of the exotherm which resulted the temperature of the flask and contents reached reflux temperature without the application of heat. Additional heat was required, however, to maintain reflux which was continued for a further three hours. Subsequently the flask and contents were allowed to cool to room temperature to give a viscous, clear, dark amber colored solution containing 66% of the polyamine of the invention. This solution was further diluted with water to 10% solids and then added directly to the plating baths as such. Analysis showed that all the chlorine originally charged as epichlorohydrin was now present as ionic chloride.

EXAMPLE 1 — Use of Diethanolamine/Epichlorohydrin/Dimethylaminopropylamine Polyamine in Alkaline NonCyanide Zinc Electroplating An alkaline non-cyanide zinc electroplating bath was prepared containing 7.5 g/l of zinc and 90 g/l of sodium hydroxide. The electrodeposit obtained from this bath without additives was black, porous, non-adherent and of little commercial value.

Test 1: To the bath was added 1.0 g/l of the diethanolamine/epichlorohydrin/dimethylaminopropylamine polyamine of Preparation 2. The electrodeposit obtained on a steel cathode in a 2 amp/5 minute, 267 ml Hull cell test at 25° C was smooth, semi-bright and of commercial value over the current density range 20 to 1200 A/m² (2 to 120 A/ft²).

Test 2: To the bath from Test 1 above were added 1.0 g/l of 1-benzyl pyridinium 3-carboxylate and 7.5 g/l of Rochelle salt as additional brightening agents. A repeat Hull cell test now showed a full bright, lustrous zinc deposit of excellent commercial value over the entire current density range of 0 to 1200 A/m² (0 to 120 A/ft²).

COMPARISON 1 — Comparison Test to Using the Initial Diethanolamine/Epichlorohydrin Condensation Product in Alkaline Non-Cyanide Zinc Plating Test 1: To a fresh alkaline non-cyanide electroplating bath containing 7.5 g/l of zinc and 90 g/l of sodium hydroxide was added 1.0 g/l of the initial diethanolamine/epichlorohydrin condensation product of Preparation 1. The electrodeposit obtained on a steel cathode in a 2 amp/5 minute, 267 ml Hull cell test at 25° C showed a gray black, finely porous zinc deposit of no commercial value over the current density range of 0 to 1200 A/m² (0 to 120 A/ft²).

Test 2: To the bath from Test 1 above were added 1.0 g/l of 1-benzyl pyridinium 3-carboxylate and 7.5 g/l of Rochelle salt as additional brightening agents.

A repeat Hull cell test now showed moderately bright zinc deposits in the limited current density ranges 0 to 120 and 240 to 600 A/m² (0 to 12 A/ft² and 24 to 60 A/ft²) and dull gray zinc deposits in the current density range 120 to 24 A/m² (12 to 24 A/ft²) and above 600 A/m² (60 A/ft²). Over the entire current density range of 0 to 1200 A/m² (0 to 120 A/ft²) the deposit was considerably inferior to that demonstrated for the diethanolamine/epichlorohydrin/dimethylaminopropylamine polyamine in Example 1.

PREPARATION 3 — Formation of Diethanolamine (1 mole)/Epichlorohydrin (2 moles)/Ethylenediamine (1 mole) Polyamine To a 30 g sample of the diethanolamine/epichlorohydrin condensation product of Preparation 1 were added 25 g of water and 4 g of ethylenediamine and the whole refluxed for two hours. The refluxed product was then cooled and diluted with water to give a 10% polyamine solution which was added directly to the plating baths. Analysis showed all the chlorine originally added as epichlorohydrin to be present as chloride ion.

EXAMPLE 2 — Use of Diethanolamine/Epichlorohydrin/Ethylenediamine Polyamine in Alkaline Cyanide Zinc Plating An alkaline cyanide zinc plating bath containing 11.5 g/l of zinc, 96 g/l of sodium hydroxide and 11.5 g/l of sodium cyanide was prepared. The electrodeposit obtained from this bath without additives was a dark dull gray and of little commercial value.

Test 1: To the bath was added 2.0 g/l of the diethanolamine/epichlorohydrin/ethylenediamine polyamine of Preparation 3. The electrodeposit obtained on a steel cathode in a 2 A/5 minute, 267 ml Hull cell test a 25° C showed smooth semi-bright zinc of acceptable commercial quality over the current density range 0 to 1000 A/m² (0 to 100 A/ft²).

Test 2: To the bath from Test 1 was added 1.0 g/l of 1-benzyl pyridinium 3-carboxylate as brightener. A repeat Hull cell test now showed a bright zinc deposit of good commercial quality over the current density range 120 to 1000 A/m² (12 to 100 A/ft²). Below 120 A/m² (12 A/ft²) the bright deposit showed a light white haze. This light white haze below 120 A/m² (12 A/ft²) was greatly diminished on a second cathode panel from the same bath and was virtually eliminated on a third panel.

COMPARISON 2 — Comparison Test Using the Initial Diethanolamine/Epichlorohydrin Condensation Product in Alkaline Cyanide Zinc Plating To a fresh alkaline cyanide zinc electroplating bath containing 11.5 g/l of zinc, 96 g/l of sodium hydroxide and 11.5 g/l of sodium cyanide were added 2 g/l of the diethanolamine/epichlorohydrin condensation product of Preparation 1 together with 1 g/l of 1-benzyl pyridinium 3-carboxylate. The electrodeposit obtained on a steel cathode in a 2 A/5 minute, 267 ml Hull cell test at 25° C showed bright zinc of good commercial quality over the current density range 240 to 1000 A/m² (24 to 100 A/ft²). Below 240 A/m² (24 A/ft²) the deposit showed a heavy white haze. This white haze was not significantly reduced on a second, third or fourth cathode panel from the same bath.

What is claimed is:

1. An aqueous addition agent for the electrodeposition of zinc from an alkaline bath, said addition agent comprising a water-soluble polyamine brightener prepared by condensing an alkanolamine with an epihalohydrin in proportions of at least about 2 moles of epihalohydrin per mole of alkanolamine to produce a condensation product which is essentially completely water-soluble and free from epihalohydrin, and reacting said condensation product with at least 0.3 mole of ammonia or an amine other than an alkanolamine per mole of alkanolamine until the total ionic halogen is at least about 1 mole per mole of alkanolamine.

2. An addition agent of claim 1 having a concentration of about 2 to 50 weight percent of polyamines in water.

3. An addition agent of claim 1 having a concentration of about 2 to 20 weight percent of polyamines in water.

4. An addition agent of claim 1 which also contains as a brightener at least one of an aromatic aldehyde and a 1-alkyl 3-substituted pyridinium compound, said brightener being in a weight ratio to said polyamines in the range of 1:100 to 100:1.

5. An addition agent of claim 1 in which the condensation is done at temperatures in the range of about 50° to 150° C for a time in the range of about 4 to 16 hours, and the reaction with the amine is done at temperatures in the range of about 80° to 110° C for a time in the range of about 1 to 6 hours.

6. An addition agent of claim 1 in which the polyamine is made with about 1.0 mole of amine per mole of alkanolamine.

7. An addition agent of claim 1 in which the epihalohydrin is epichlorohydrin.

8. An addition agent of claim 1 in which the alkanolamine is diethanolamine.

9. An addition agent of claim 1 in which the amine is a bisamine having a tertiary amine function.

10. An addition agent of claim 9 in which the amine is dimethylaminopropylamine.

11. An addition agent of claim 1 in which the compound reacted with the condensation product is ammonia or a primary amine.

12. An addition agent of claim 11 in which the amine is a primary bisamine.

13. An addition agent of claim 12 in which the amine is ethylene diamine.

14. An aqueous alkaline bath for the electrodeposition of zinc comprising a source of zinc ions and from about 0.1 g/l to the solubility limit of a polyamine brightener of claim 1.

15. A bath of claim 14 containing up to about 5 g/l of the polyamine.

16. A bath of claim 14 which contains essentially no cyanide ion and in which the amine is a bisamine having a tertiary amine function.

17. A bath of claim 14 which contains cyanide ion to aid in electroplating up to a concentration about 25 g/l and in which the amine is dimethylaminopropylamine.

18. A bath of claim 14 which also contains as a brightener a 1-alkyl 3-substituted pyridinium compound.

19. A bath of claim 18 in which the pyridinium compound is 1-benzyl pyridinium 3-carboxylate.

20. A bath of claim 14 which also contains as a brightener at least one of a 1-alkyl 3-substituted pyridinium compound and an aromatic aldehyde, in a weight ratio to the polyamines in the range of 1:100 to 100:1.

21. A bath of claim 14 which also contains a metal-sequestering agent.

22. A bath of claim 19 which contains about 0.1 to 5 g/l of 1-benzyl pyridinium 3-carboxylate, and about 1 to 15 g/l of at least one of sodium potassium tartrate and sodium glucoheptonate as a sequestering agent.

23. A bath of claim 14 which contains about 0.1 to 5 g/l of at least one of anisaldehyde, veratraldehyde, piperonel, o-, m- and p-hydroxybenzaldehydes, and vanillin, and about 1 to 15 g/l of at least one of sodium potassium tartrate and sodium glucoheptonateas a sequestering agent.

24. An electroplating process for the production of a zinc coating on an object by passing an electrical current from an anode through a bath of claim 12 to a cathode which is said object.

25. A process of claim 24 in which the electroplating is conducted at a pH above about 12 and in the temperature range of about 20° to 65° C.

* * * * *